US006935398B2

(12) United States Patent
Koot et al.

(10) Patent No.: US 6,935,398 B2
(45) Date of Patent: Aug. 30, 2005

(54) OPERATING UNIT FOR A WINDOW COVERING

(75) Inventors: Hermanus Marinus Ignatius Koot, Montfoort (NL); Frederik Meenks, Woerden (NL)

(73) Assignee: Techniku Holding B.V., Woerden (NL)

( * ) Notice: Subject to any disclaimer, the term of this patent is extended or adjusted under 35 U.S.C. 154(b) by 0 days.

(21) Appl. No.: 10/430,741

(22) Filed: May 6, 2003

(65) Prior Publication Data

US 2003/0226644 A1 Dec. 11, 2003

(30) Foreign Application Priority Data

May 6, 2002 (NL) ..... 1020541
Dec. 6, 2002 (NL) ..... 1022103

(51) Int. Cl.[7] ..... E06B 3/48

(52) U.S. Cl. ..... 160/84.06; 160/84.02; 160/115; 160/170

(58) Field of Search ..... 160/84.02, 113, 160/115, 168.1 P, 170, 84.06, 107, 171, 172 R, 84.04

(56) References Cited

U.S. PATENT DOCUMENTS 6,230,784 B1 * 5/2001 Sanz et al. ..... 160/84.02
6,338,377 B1 * 1/2002 Domel ..... 160/84.02

FOREIGN PATENT DOCUMENTS

CH 672658 * 7/1986

* cited by examiner

*Primary Examiner*—Blair M. Johnson
(74) *Attorney, Agent, or Firm*—Rader, Fishman & Grauer, PLLC

(57) ABSTRACT

A window covering operating unit including a stationary mountable first profile, a stationary mountable second profile, a profile movable between the first and second profile; and window covering material which is mountable between the movable profile and the first or second profile, wherein the window operating unit includes a first rotatable winding shaft which is arranged in a stationary profile and on which can be wound and unwound a first winding cord engaging on the movable profile and wherein the window operating unit further includes a second rotatable winding shaft which is arranged in a stationary profile and on which can be wound and unwound a second winding cord engaging on the movable profile, wherein the second winding shaft extends adjacently of and substantially parallel to the first winding shaft.

17 Claims, 3 Drawing Sheets

OPERATING UNIT FOR A WINDOW COVERING

TECHNICAL FIELD

The present invention generally relates to window coverings and more particularly relates to an operating unit for operating a window covering.

BACKGROUND OF THE INVENTION

Such a type of window covering is also known as a blind. The window covering material is formed here by pleated or cellular curtains. Such a window covering is applied for instance in roof lights or in the sloping roof panels of conservatories. Although such window covering are usually installed obliquely, they are also used horizontally or vertically. A characteristic of blinds is that they have at least three profiles. A first profile and a second profile, or the upper and lower profile in an application which is other than horizontal, are mounted fixedly on or in the window frame, while a third profile, which is movable, is placed therebetween. The material of the curtain lies between the upper profile and the movable profile and/or between the lower profile and the movable profile, depending on the configuration. It is also possible to provide covering material between the upper profile and the movable profile as well as between the lower profile and the movable profile. One or more support cords or tensioning cables can be provided to support the window covering material and optionally the movable profile. Some window covering material will sag without support cords. The window covering is most commonly rectangular, although other forms (triangular or trapezoidal) of window coverings are also known.

An operating unit moves the movable profile reciprocally by means of pull cords engaging on the movable profile.

Many existing operating units operate on the basis of friction wherein a continuous cord is wound several times round a roll and brought to tension. Friction between the roll and the cord provides transfer of movement. The more friction present during reciprocating movement of the movable profile, the more drive energy is lost. This phenomena makes battery operated units less suitable in battery-powered drive systems. Operating units are further known wherein use in made of one or more wind-up shafts. Although these encounter less friction and are therefore more suitable for the application of battery-powered systems, these known operating units do however have such large dimensions that they are not suitable, or at least less so, for relatively narrow and long windows. In addition, the existing operating units quite often meet with problems during winding up and/or subsequent unwinding of said pull cords.

It is therefore an object of the present invention to provide an operating unit for window coverings of the above stated type, wherein at least one of the above stated drawbacks or other problems associated with the prior art are obviated.

SUMMARY OF THE INVENTION

According to a first aspect of the present invention, there is provided for this purpose an operating unit which comprises displacing means for displacing the movable profile, the displacing means comprising:

a first rotatable winding shaft which is arranged in a stationary profile and on which can be wound and unwound a first and a third winding cord engaging on the movable profile;

a second rotatable winding shaft which is arranged in a stationary profile and on which can be wound and unwound a second and a fourth winding cord engaging on the movable profile, wherein the second winding shaft extends adjacently of and substantially parallel to the first winding shaft. By applying two winding shafts and positioning these adjacently of each other an extremely compact, operating unit can be realized. Assuming a cord diameter of for instance 0.8 mm, it is possible with the operating unit according to the invention to realize a window covering which is only 0.4 m wide, wherein the operating unit has a sufficient wind-up capacity to deal with a window covering length (height) of at least 4 m.

The operating unit comprises a third and fourth winding cord which can be wound and unwound on respectively the first and second winding shaft. It is particularly for the stability of the movable profile that the use of two sets of winding cords is recommended, wherein one set is positioned on each end of the movable profile. The first winding cord, and where necessary the fourth winding cord, is arranged for the purpose of pulling the movable profile in the direction of the first profile, while the second winding cord, and where necessary the third winding cord, is arranged for the purpose of pulling the movable profile in the direction of the second profile.

The winding cords can be fastened fixedly to the movable profile. It is however also possible to fasten the first and fourth and/or the second and third winding cord to each other. This has the advantage of simplifying alignment of the movable profile.

In another preferred embodiment the winding cords are connected resiliently to each other or the winding cords engage resiliently on the movable profile. The cords are hereby easy to tension and keep tensioned.

In a further preferred embodiment the operating unit comprises adjustable tensioning means for setting the tension on the winding cords. This means that after installation the tension on the cords can still be changed, preferably in the accessible movable profile.

In a further preferred embodiment both winding shafts, and preferably also the drive of the winding shafts, can be arranged in the same stationary profile. This has a number of advantages. One of the advantages is that mounting of the operating unit, beforehand in new systems or later in already existing systems, becomes simpler.

According to another aspect of the present invention, there is provided in operating unit which comprises displacing means for displacing the movable profile, which displacing means comprise at least one rotatable winding shaft for arranging in a stationary profile and on which can be wound and unwound a winding cord connecting to the movable profile; the winding shaft comprising:

a rotatably drivable inner shaft, an outer shaft which is slidable over the inner shaft and arranged co-rotatably with the inner shaft and on which the winding cord can be wound and unwound.

shifting means for shifting the slidable outer shaft during unwinding and winding of the winding cord. Through the use of such a construction the winding cord is wound neatly onto the outer shaft, thereby reducing the chance of the winding cords becoming tangled with the possible consequence of the operating unit not functioning properly.

The outer surface of the outer shaft can have a smooth surface onto which the winding cord can be wound. In another preferred embodiment of the invention, the operating unit is provided with shifting means in the form of receiving grooves, preferably spiral-shaped, provided in the outer surface of the outer shaft for receiving the relevant winding cord. Due to the form of the grooves the relevant winding cord is compelled to be wound up in a spiral, thus preventing entanglement of the winding cord. The slidable outer shaft is shifted relative to the inner shaft by the forces occurring during winding-up.

In another preferred embodiment the shifting means comprise internal and extend screw thread provided on the outer shaft and on a bearing unit of the inner shaft. During rotation of the inner shaft and the rotation of the outer shaft corresponding therewith, the screw thread ensures that the outer shaft is shifted relative to the inner shaft. The part of the outer surface of the outer shaft onto which the winding cord is wound can herein be smooth or can contain the above described grooves.

The operating unit preferably comprises an electric motor for driving one or more winding shafts, in the embodiments with two or more shafts preferably a single electric motor for driving all shafts, in addition to transmitting and receiving means for transferring control signals between a remote control and the electric motor. The electric motor, and preferably also the transmitting and receiving means, can herein be battery-powered. The battery supply is then fastened in or on the relevant profile.

DETAILED DESCRIPTION OF THE PREFERRED EMBODIMENTS

Figure 1:
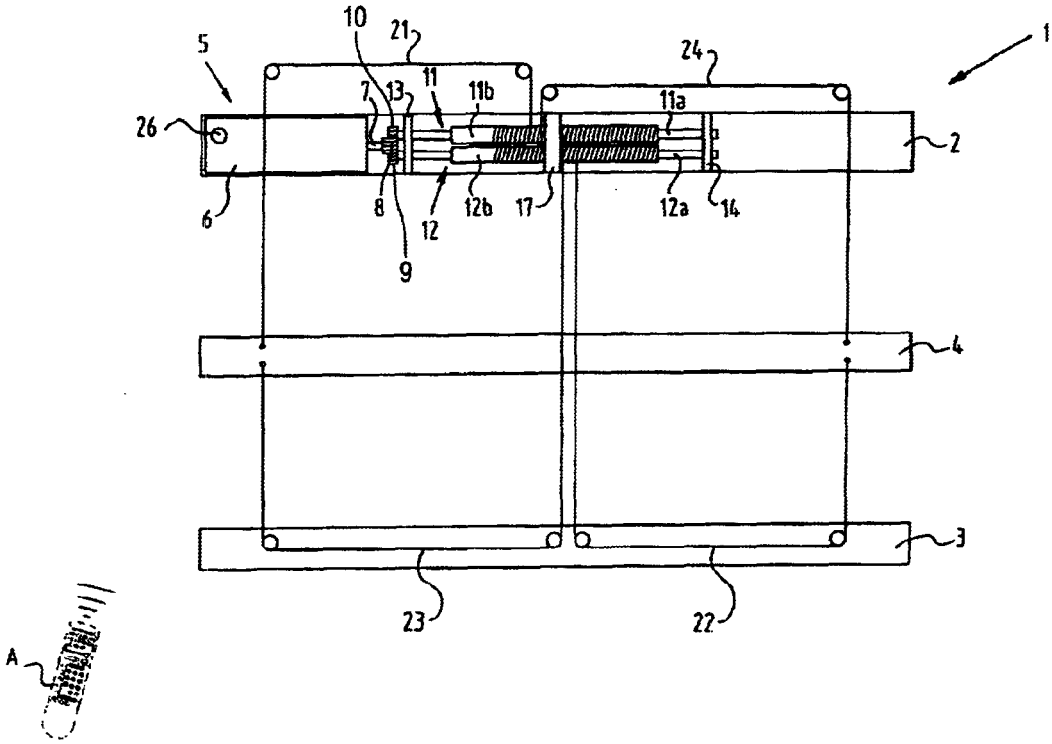
FIG. 1 shows an exploded schematic view of a preferred embodiment of an operating unit for window covering.

FIG. 1 shows a window covering 1 with an upper rail 2, a lower rail 3 and a rail 4 movable between upper rail 2 and lower rail 3. The fabric or fabrics with which the window can be covered is not shown for the sake of simplicity. The fabric can however be fastened in known manner to the movable rail 4 on one side and the upper or lower rail 2,3 on the other. The operating unit 5 with which the movable rail 4 can be operated is placed as a single unit in upper rail 2. Operating unit 5 comprises an electric motor 6 powered by a number of batteries (not shown) arranged in, on or close to upper rail 2. Drive shaft 7 of electric motor 6 drives a toothed wheel 8 which in turn drives the toothed wheels 9 and 10 of winding shafts 11 and 12.

The two winding shafts 11 and 12 lie directly adjacently of each other in upper rail 2. Winding shafts 11, 12 are constructed respectively from inner shafts 11*a*, 12*a* and outer shafts 11*b* and 12*b*. Outer shafts 11*b*, 12*b* slide over inner shafts 11*a* and 12(*a*) respectively. Inner shafts 11*a* and 12*a* are both longer than their respectively associated outer shafts 11*b*,12*b*, and both inner shafts 11*a*, 12*a* are mounted at the two ends in bearing blocks 13 and 14. The slidable outer shafts 11*b*, 12*b* co-rotate with inner shafts 11*a*, 12*a* in that protrusions 15 (see FIG. 2*a*) are provided on the inner shafts and corresponding recesses 16 on the outer shafts. Situated in the middle of the system, midway between the two bearing blocks, is a third block referred to as a shifting unit 17 where the four winding cords 21, 22, 23, 24 come together. The cords are guided with minimal friction to the slidable shafts 11*b*, 12*b* by shifting unit 17.

Two sets of cords are necessary for the stability of movable rail 4, one on each side. One set consists of a cord with which the movable rail 4 can be pulled upward 21, 24, and a cord with which the movable rail 4 can be pulled downward 23, 22. Each set of cords is fixed to one of the slidable shafts, with one cord on each side. Prior to mounting, the cords which serve to lift 21, 24 the movable rail 4, are fixed to one side of their respectively associated slidable shafts. This allows the cords 21, 24 to raise and lower the fabric.

The amount of cord that must be provided on the slidable shafts 11*b*, 12*b* is a function of height of the curtain (or fabric), whereby the shafts 11*b*, 12*b* are full or practically full only at the maximum retraction of the curtain, for instance a height of 4 meters or more. The cords for moving the movable rail 4 downward 23, 22 run straight downward mutually adjacently from the center, through the movable rail 4 to lower rail 3. They are there rerouted to the two sides of lower rail 3. The cords 22, 23 herein run, for instance, within an opening in lower rail 3. The cords are then guided upward to movable rail 4. Here they are fixed to movable rail 4, this in a manner such that they can be made tighter or looser. The two cords 21 and 24 for moving the movable rail 4 upward, are routed from the center to the two sides of upper rail 2, wherein the cords in upper rail 2 run below the wind-up system and motor 5 where they are rerouted downward to movable rail 4 where they are fastened to the rail 4 separately, or are fastened to each other, then fastened to the rail 4. After installation of the operating unit in the window frame, the tension on the cords can be changed in the accessible movable rail 4 by way of an adjusting means (not shown).

The installed operating unit can be simply opened and closed by using a switch provided on a rail or by using a remote control A, as shown in FIG. 1. In the latter case the motor 6 is activated by a signal transmittal from the infrared remote control A, which is received by a receiving infrared detector 26 and processed by control electronics (not shown). The motor drives the two shafts 11, 12 of the wind-up mechanism. In the case of each shaft, cord is wound up on the one side and simultaneously cord is unwound on the other side. In the two extreme positions (fully open or fully closed) almost all cord is on one side. There are still a few windings on the other side so that the cord is never fully unwound. This enables a fine adjustment of the unit.

Figure 2A:
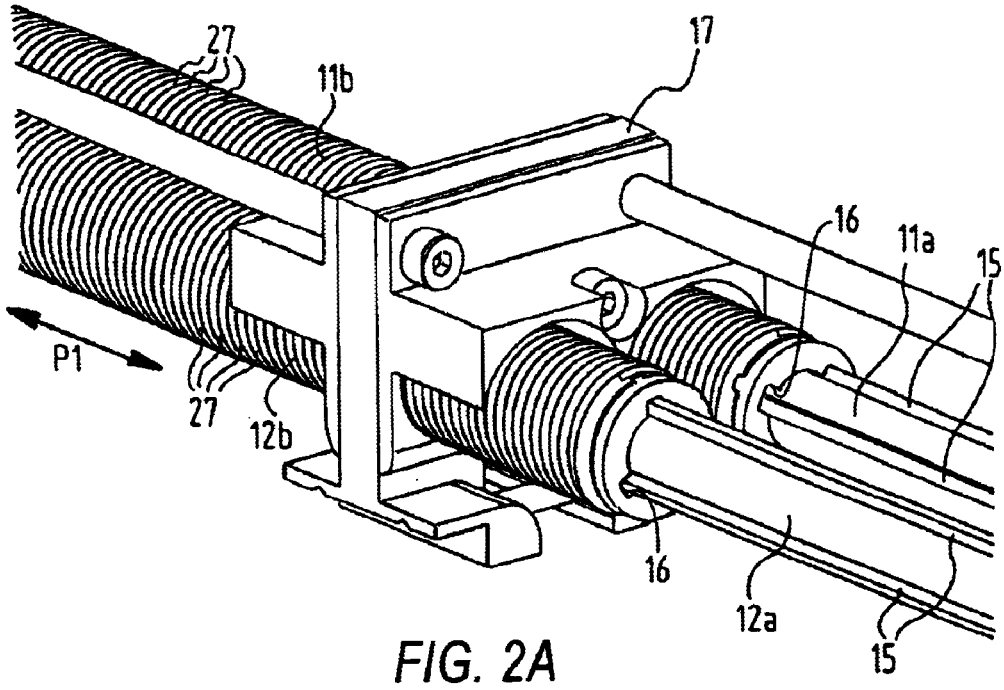
FIGS. 2*a*, 2*b*, 3*a* and 3*b* show partly cut-away views in perspective of preferred embodiments of the invention.
Figure 2B:
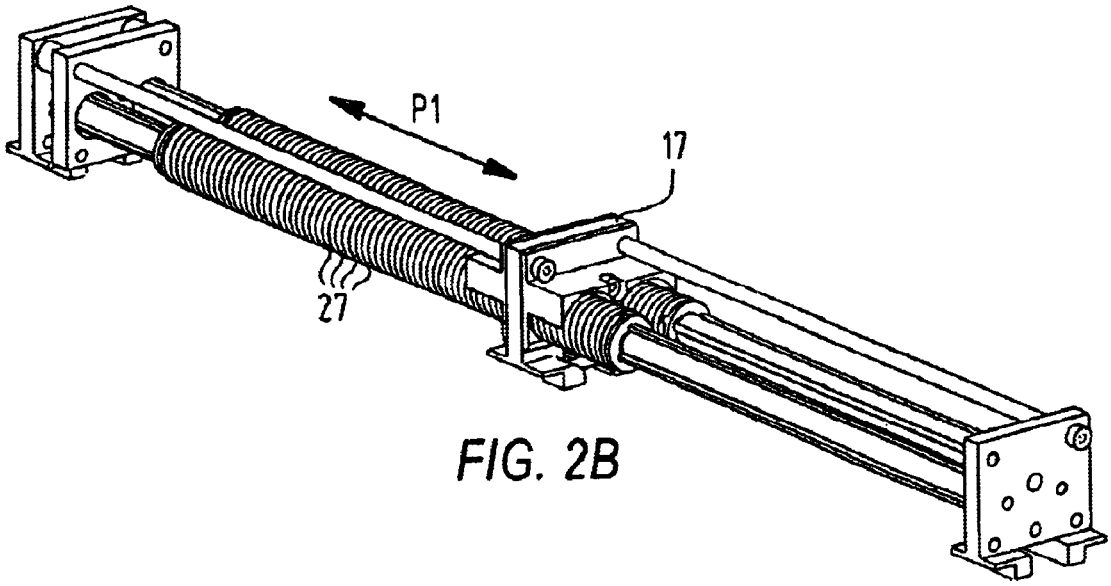

FIGS. 2*a* and 2*b* show that slidable outer shafts have an outer surface in which a spiral-shaped groove 27 is arranged. When the outer shafts are rotated the different winding cords are received in these grooves. These grooves per se can already bring about the required shifting of the outer shafts 11*b*, 12*b* relative to inner shafts 11*a*, 12*a*. In the disclosed embodiment, the middle shifting unit 17 is however also provided with grooves, this such that the grooves 27 in the outer shafts 11*b*, 12*b* and the grooves in shifting unit 17 function as internal and external screw thread. This means that during rotation of inner shafts 11*a* and 12*a* and the corresponding rotation of outer shafts 11*b* and 12*b*, the outer shafts 11*b* and 12*b* are compelled to shift (arrow P) by virtue of the interaction between grooves 27 and the grooves in the shifting unit 17. The result hereof is that the winding cords are wound up and unwound neatly.

Figure 3A:
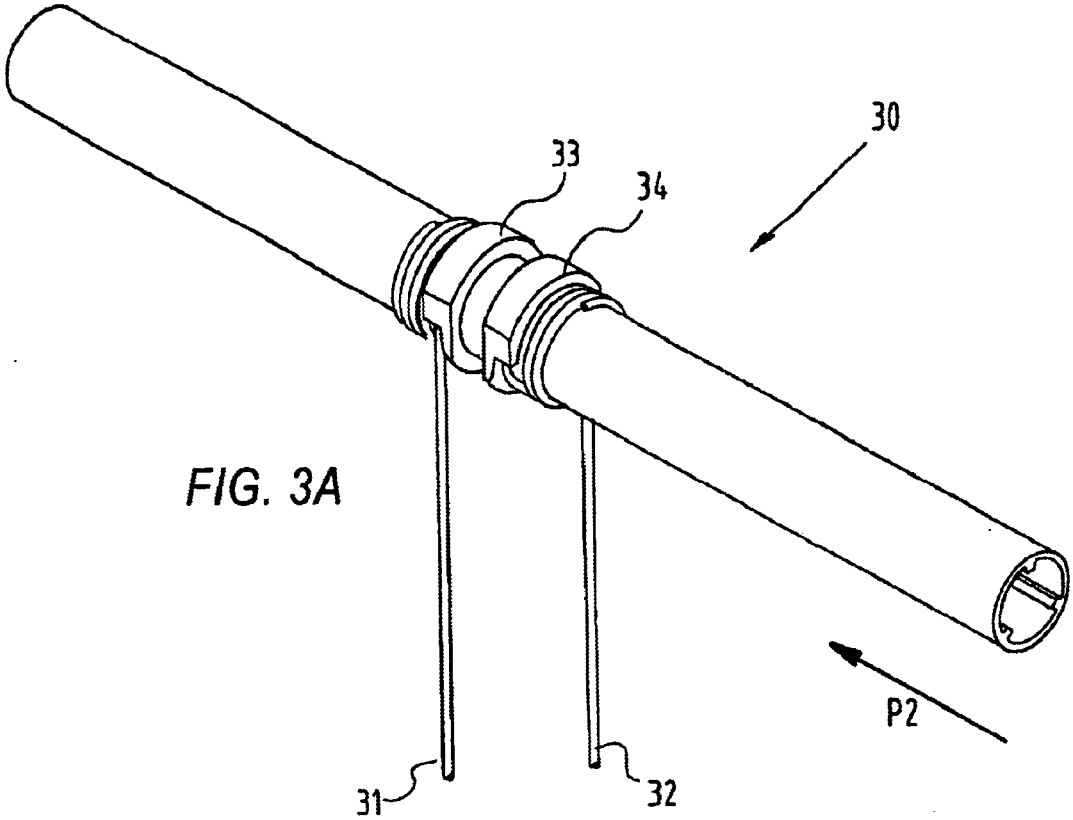
Figure 3B:
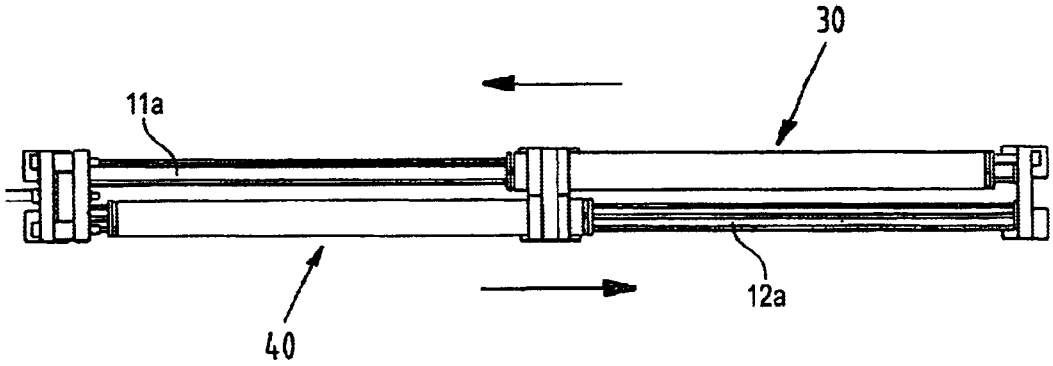

In an alternative embodiment, as shown in FIG. 3*b*, the outer surface 30 of the outer shaft has a smooth surface onto which the winding cord can be wound. In addition, inner shafts 11*a*, 12*a* are able to rotate in a corresponding direction with respect to each other while the outer shafts are shifting in an opposite direction.

The invention is not limited to the above described preferred embodiments thereof; the rights sought are defined by the following claims, within the scope of which many modifications can be envisaged.

What is claimed is:

1. Operating unit for operating a covering which wholly or partially covers at least one opening in a building structure, comprising:

a stationary, first profile, a stationary, second profile, a third profile movable between the first and second profile;

covering material which is mountable between the third movable profile and the first or second stationary profile and with which the opening can be covered.

displacing unit for displacing the movable, third profile, wherein the displacing unit includes a first rotatable winding shaft which is arranged in at least one of said first or second stationary profiles and on which a first and a third winding cord is wound, and extends to said movable, third profile; and a second rotatable winding shaft which is arranged in at least one of said first or second stationary profiles and on which a second and a fourth winding cord is wound, and extends to said movable, third profile, wherein the second winding shaft extends adjacent, and substantially parallel to the first rotatable winding shaft.

2. Operating unit as claimed in claim 1, wherein the first winding cord and the second winding cord are arranged such that they pull the third, movable profile in the direction of the first profile, wherein the third winding cord and fourth winding cord are arranged such that they pull the movable profile in the direction of the second, third profile.

3. Operating unit as claimed in claim 2, wherein the first and second winding shafts are arranged in the first stationary profile, and wherein the first and second winding cords extend directly from the first, stationary profile to the third, movable profile and the third and fourth winding cords extend from the first, stationary profile to the third, movable profile by way of the second profile.

4. Operating unit as claimed in claim 1, wherein the first, second, third, and fourth winding cords engage in the vicinity of one or more ends of the movable profile.

5. Operating unit as claimed in claim 4, wherein the first and third winding cord are fastened to each other or the second and fourth winding cords are fastened to each other.

6. Operating unit as claimed in claim 1, wherein said first and second rotatable winding shafts are arranged in the same stationary profile.

7. Operating unit as claimed in claim 1, further including an electric motor for driving at least one of said winding shafts, and further including a transmitting and receiving means for transferring control signals between a remote control and the electric motor.

8. Operating unit as claimed in claim 7, further including a battery unit in or on a profile for supplying electrical power to the electric motor.

9. Operating unit as claimed in claim 1, wherein at least one of said first and second rotatable winding shafts further includes:

a rotatably drivable inner shaft, an outer shaft which is slidable over said inner shaft and arranged co-rotatably with said inner shaft and on which at least one of said winding cords can be wound and unwound, a shifting unit for shifting the slidable outer shaft during unwinding and winding of the winding cord.

10. Operating unit as claimed in claim 9, wherein said shifting unit includes external screw threads provided on the outer shaft and internal screw threads provided on a bearing unit.

11. Operating unit as claimed in claim 9, wherein said shifting unit is formed by receiving spiral-shaped grooves, provided in an outer surface of said outer shaft wherein said spiral-shaped grooves are effective for receiving the winding cord.

12. Operating unit as claimed in claim 9, wherein said shifting unit includes winding cord guides.

13. Operating unit as claimed in claim 12, wherein a winding cord guide groove is arranged in said cord guide.

14. Operating unit as claimed in claim 9, wherein said at least two of said winding cords engaging the same winding shaft are wound onto the winding shaft in opposing directions.

15. Operating unit as claimed in claim 9, further including an electric motor for driving at least one of said winding shafts, and further including a transmitting and receiving means for transferring control signals between a remote control and the electric motor.

16. Operating unit as claimed in claim 15, further including a battery unit in or on one of said profiles for supplying electrical power to the electric motor.

17. Operating unit as claimed in claim 9, wherein the covering is a window covering with which at least one window can be covered.

* * * * *